US006883238B1

(12) United States Patent
Tran

(10) Patent No.: US 6,883,238 B1
(45) Date of Patent: Apr. 26, 2005

(54) HAIRSTYLING SCISSORS

(76) Inventor: Khiem Tran, 505 N. Sheridan, Bay City, MI (US) 48708

( * ) Notice: Subject to any disclaimer, the term of this patent is extended or adjusted under 35 U.S.C. 154(b) by 6 days.

(21) Appl. No.: 10/657,003

(22) Filed: Sep. 8, 2003

(51) Int. Cl.[7] ..... B26B 13/20
(52) U.S. Cl. ..... 30/232; 30/341
(58) Field of Search ..... 30/271, 341, 231, 30/232

(56) References Cited

U.S. PATENT DOCUMENTS

| | | | | |
|---|---|---|---|---|
| 3,906,630 | A * | 9/1975 | Megna | 30/260 |
| 4,146,961 | A * | 4/1979 | Pinto | 30/341 |
| 4,184,249 | A * | 1/1980 | Megna et al. | 30/341 |
| 4,254,551 | A * | 3/1981 | Megna et al. | 30/341 |
| 4,642,895 | A * | 2/1987 | Gauvry | 30/341 |
| 4,742,617 | A | 5/1988 | Gauvry | |
| D302,784 | S | 8/1989 | Nakakuma | |
| 5,060,381 | A * | 10/1991 | Taberlet | 30/232 |
| 5,109,608 | A * | 5/1992 | Pracht | 30/341 |
| 5,781,999 | A | 7/1998 | Chang | |
| 5,819,416 | A * | 10/1998 | Robinson et al. | 30/257 |
| 6,018,875 | A | 2/2000 | Miranda | |
| 6,249,977 | B1 | 6/2001 | Knoop | |
| 6,397,478 | B1 * | 6/2002 | Bornancini | 30/232 |
| 6,665,939 | B1 * | 12/2003 | Adachi | 30/232 |

* cited by examiner

*Primary Examiner*—Hwei-Siu Payer

(57) ABSTRACT

A pair of hairstyling scissors includes first and second members pivotally connected to each other. Each member includes a cutting portion and a handle portion integral therewith, respectively. The handle portion of the second member is adjustable and includes a thumb receiving member and a pivot mechanism that allows the thumb-receiving member to pivot between first and second positions. Advantageously, the thumb-receiving portion allows a user to freely position his/her thumb into and out of the adjustable handle portion during operating conditions.

8 Claims, 3 Drawing Sheets

FIG. 4
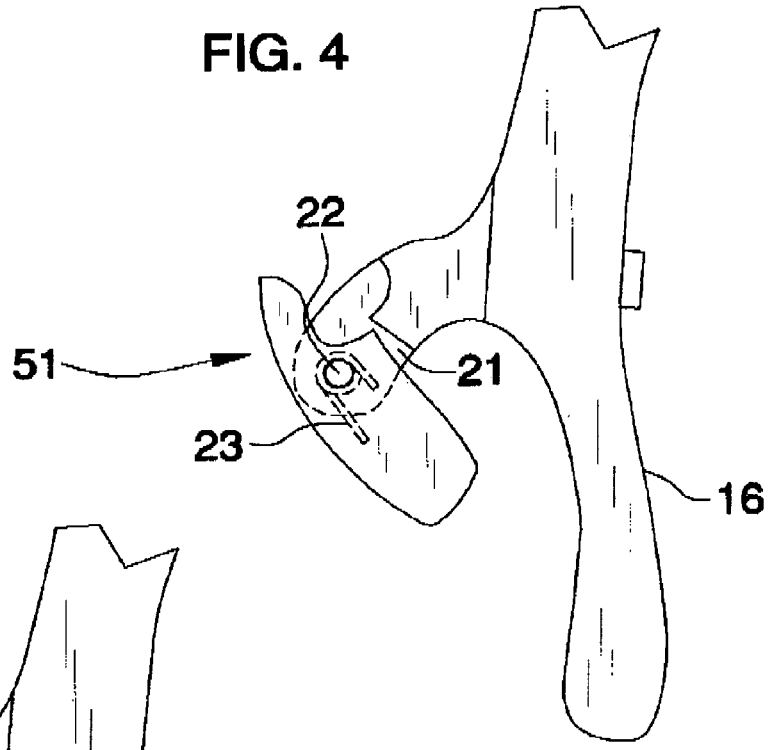
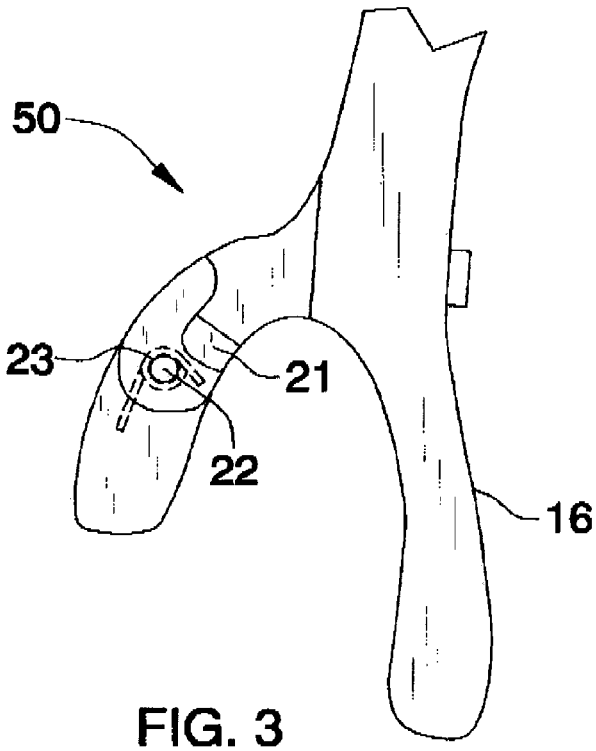
FIG. 3

HAIRSTYLING SCISSORS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical field

This invention relates to the field of cutting devices and, more particularly, to a pair of scissors for cutting hair with an open-ended thumb handle for greater ease of use and improved comfort when cutting hair.

2. Prior Art

Conventional scissors include two cutting blades with handles attached to the blades for operation. The lower handle normally has an opening for the insertion of a plurality of fingers to operate the scissors while the upper handle normally accommodates only the thumb. Because any mass-produced scissors sold to the general public must have a thumb hole large enough to accommodate a plethora of thumb sizes, the thumb hole is often larger than necessary for most people, especially women with small hands. As a result, a user's thumb often has a tendency to slide around the thumb hole while cutting, resulting in a less than ideal grip on the scissors. This slippage of the thumb reduces the operator's control of the scissors, thereby reducing the accuracy of the cut. This is particularly critical when cutting hair or making fine paper or material cuts where accuracy is essential.

Another problem commonly faced by haircutters and those who use scissors frequently is the inability to remove their thumb from the thumb hole quickly. Haircutters are constantly removing their hands from their scissors to use other grooming utensils and apply liquid or spray materials to a client's hair. A pair of scissors that enables the haircutter to move his/her hand freely and quickly in and out of the scissors would reduce the time needed to cut hair and make the hair stylist more efficient.

Accordingly, a need remains for a pair of scissors with an adjustable, open-ended thumb handle for greater control and ease of use.

BRIEF SUMMARY OF THE INVENTION

In view of the foregoing background, it is therefore an object of the present invention to provide a pair of scissors with an open-ended thumb handle for greater ease of use and accuracy. These and other objects, features, and advantages of the invention are provided by a pair of scissors that include a first member with a cutting portion and a handle portion integral therewith. The pair of scissors further includes a second member pivotally connected to the first member and disposed therebeneath.

The second member includes a cutting portion and an adjustable handle portion integral therewith. The adjustable handle portion includes a thumb-receiving member and a mechanism for selectively pivoting same between first and second positions so that a user can operably move a thumb into and out of the adjustable handle portion. The pivot mechanism includes a pin for connecting the thumb-receiving member to the adjustable handle portion and for allowing the thumb-receiving member to pivot thereabout. A spring operably engaged with the pin causes the thumb-receiving member to return to the first position after same is caused to move to the second position.

A preferred embodiment of the present invention may further include an elongated finger stop having a first end portion connected to the handle portion of the first member and having an opposed second end portion extending outwardly and rearwardly from the handle portion of the first member. Another embodiment of the present invention may further include a bumper member connected to the handle portion of the first member. Such a bumper member extends outwardly from the first member and towards the adjustable handle portion of the second member to prevent the adjustable handle portion from contacting the handle portion of the first member while operating.

The handle portion of the first member preferably has an aperture formed therein for receiving a plurality of appendages of a user therethrough. The aperture may have an insert, preferably formed from rubber material, removably disposed about its inner perimeter for providing comfort to a user's appendages during operation.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 3 is an enlarged top plan view of the thumb-receiving member at a first position; and FIG. 4 is an enlarged top plan view of the thumb-receiving member at a second position.

DETAILED DESCRIPTION OF THE INVENTION

Figure 1:
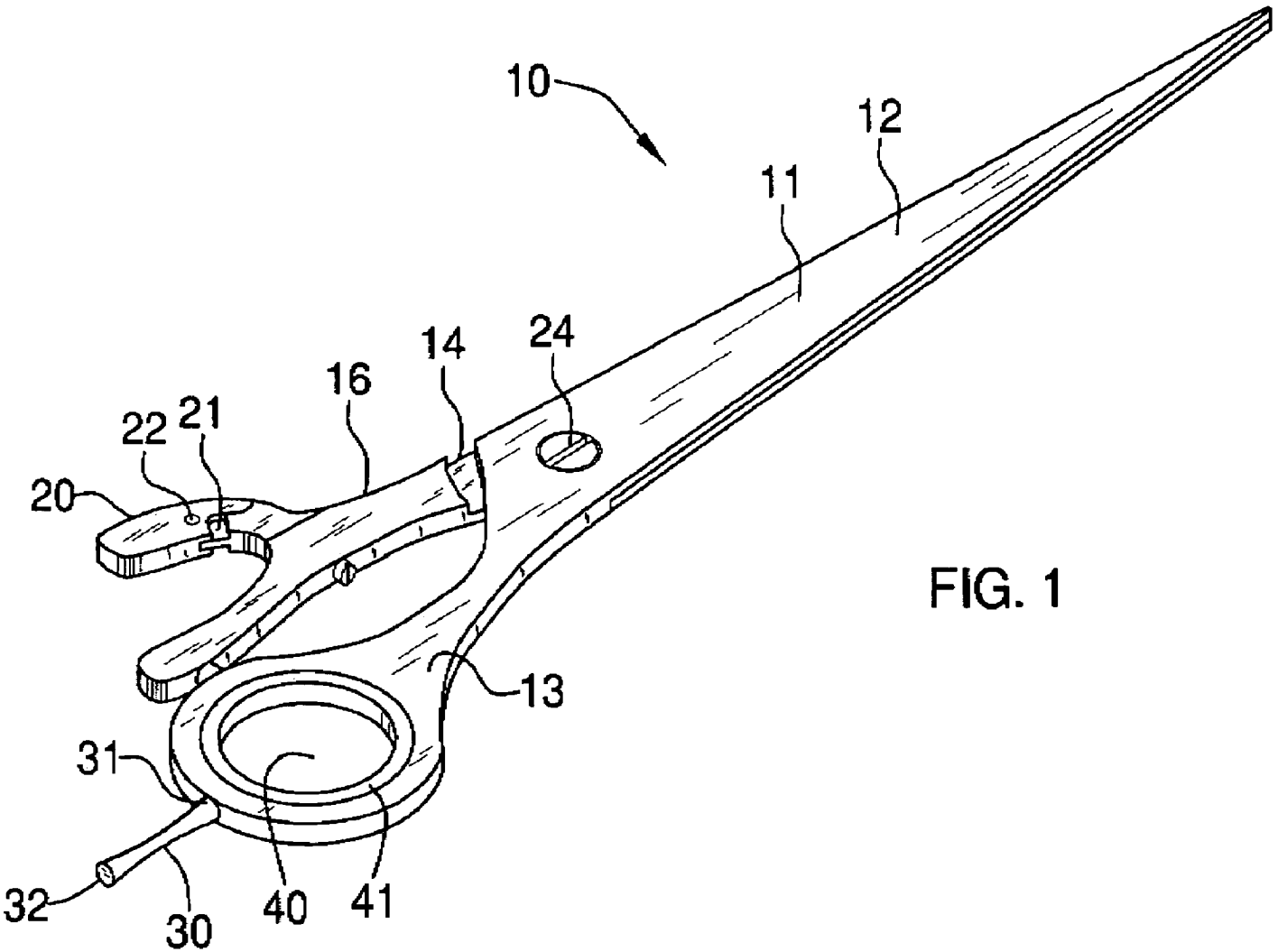
FIG. 1 is a perspective view showing a pair of hairstyling scissors, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

The device of this invention is referred to generally in FIGS. 1–4 by the reference numeral 10 and is intended to provide a pair of hairstyling scissors. It should be understood that the pair of scissors 10 may be used to cut many different types of material, and should not be limited to cutting hair.

Figure 2:
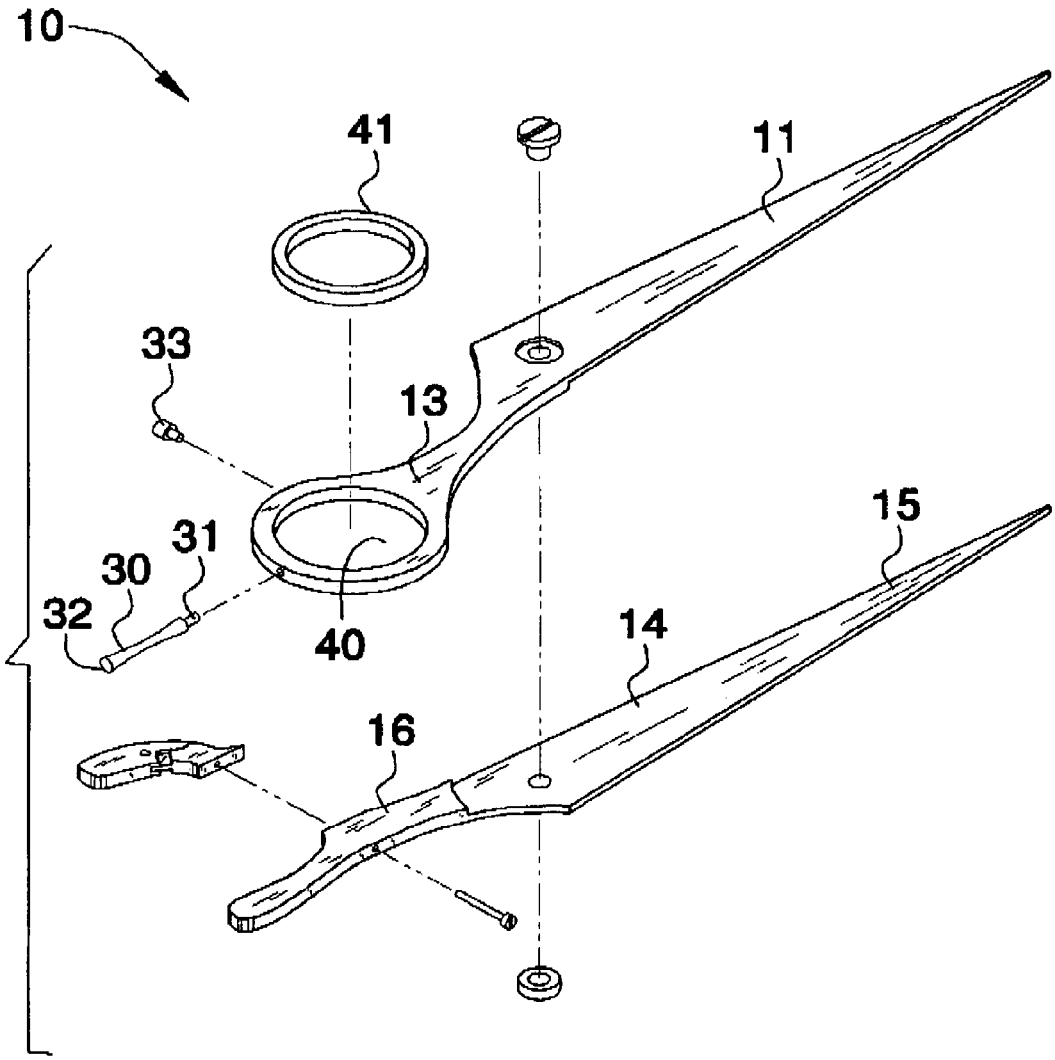
FIG. 2 is an exploded view of FIG. 1.

Referring initially to FIGS. 1 and 2, the pair of scissors 10 includes a first member 11 with a cutting portion 12 and a handle portion 13 integral therewith. The pair of scissors 10 further includes a second member 14 pivotally connected to the first member 11 and disposed therebeneath. The second member 14 includes a cutting portion 15 and an adjustable handle portion 16 integral therewith. In particular, a fastening member 24 such as a conventional screw, for example, attaches the first and second members 11, 14 adjacent their respective handle portions 13, 16. Of course, such members 11, 14 may have various shapes, as readily apparent to a person of ordinary skill in the art.

Notably, the adjustable handle portion 16 includes a thumb-receiving member 20 and a mechanism 21 for selectively pivoting same between first 50 and second 51 positions, as perhaps best shown in FIGS. 3 and 4. Advantageously, a user can operably move a thumb (not shown) into and out of the adjustable handle portion 16 quickly and easily.

Now referring to FIGS. 3 and 4 in more detail, the pivot mechanism 21 includes a pin 22 for connecting the thumb-receiving member 20 to the adjustable handle portion 16 and for allowing the thumb-receiving member 20 to pivot about pin 22. A spring 23 operably engaged with the pin 22 causes the thumb-receiving member 20 to return to the first position 50 after same is moved to the second position 51. Advantageously, the adjustable handle portion 16 is open-ended so that a user can more freely move his/her thumb during operating conditions. Of course, both left-handed and right-handed users may employ the present invention.

Referring back to FIG. 2, the pair of scissors 10 further includes an elongated finger stop 30 having a first end portion 31 connected to the handle portion 13 of the first member 11 and having an opposed second end portion 32 extending outwardly and rearwardly from the handle portion 13 of the first member 11. A bumper member 33 is connected to the handle portion 13 of the first member 11, extending outwardly therefrom and towards the adjustable handle portion 16 of the second member 14 to assist in preventing the adjustable handle portion 16 of the second member 14 from contacting the handle portion 13 of the first member 11 during operation.

The pair of scissors 10 further has an aperture 40 formed within the handle portion 13 of the first member 11 for receiving appendages of a user therethrough. The aperture 40 has an insert 41, preferably formed from rubber material, removably disposed about the inner perimeter of the aperture 40 for providing comfort to a user's appendages during operating conditions, as perhaps best shown in FIG. 2.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A pair of scissors comprising:

a first member including a cutting portion and a handle portion integral therewith;

a second member pivotally connected to said first member and being disposed therebeneath, said second member including a cutting portion and an adjustable handle portion integral therewith, said adjustable handle portion including a thumb-receiving member and means for selectively pivoting same between first and second positions so that a user can operably move a thumb into and out of said adjustable handle portion; and a bumper member connected to said handle portion of said first member and extending outwardly therefrom and towards said adjustable handle portion of said second member, said bumper member assisting to prevent said adjustable handle portion from contacting said handle portion of said first member during operating conditions;

said selectively pivoting means including:

a pin for connecting said thumb-receiving member to said adjustable handle portion and for allowing said thumb-receiving member to pivot thereabout, and a spring operably engaged with said pin and for causing said thumb-receiving member to return to the first position after same is caused to move to the second position.

2. The pair of scissors of claim 1, further comprising:

an elongated finger stop having a first end portion connected to said handle portion of said first member and having an opposed second end portion extending outwardly and rearwardly from said handle portion of said first member.

3. The pair of scissors of claim 1, wherein said handle portion of said first member has an aperture formed therein for receiving an appendage of a user therethrough, said pair of scissors further comprising an insert removably disposed about an inner perimeter of said aperture for providing comfort during operating conditions.

4. The pair of scissors of claim 3, wherein said insert is formed from rubber material.

5. A pair of scissors comprising:

a first member including a cutting portion and a handle portion integral therewith; and a second member pivotally connected to said first member and being disposed therebeneath, said second member including a cutting portion and an adjustable handle portion integral therewith, said adjustable handle portion including a thumb-receiving member and means for selectively pivoting same between first and second positions so that a user can operably move a thumb into and out of said adjustable handle portion, said selectively pivoting means comprising a pin for connecting said thumb-receiving member to said adjustable handle portion and for allowing said thumb-receiving member to pivot thereabout, and a spring operably engaged with said pin and for causing said thumb-receiving member to return to the first position after same is caused to move to the second position.

6. The pair of scissors of claim 5, further comprising:

an elongated finger stop having a first end portion connected to said handle portion of said first member and having an opposed second end portion extending outwardly and rearwardly from said handle portion of said first member.

7. The pair of scissors of claim 5, wherein said handle portion of said first member has an aperture formed therein for receiving an appendage of a user therethrough, said pair of scissors further comprising an insert removably disposed about an inner perimeter of said aperture for providing comfort during operating conditions.

8. The pair of scissors of claim 7, wherein said insert is formed from rubber material.

* * * * *